US005667398A

United States Patent [19]

Kidd et al.

[11] Patent Number: 5,667,398

[45] Date of Patent: Sep. 16, 1997

[54] MODULAR CONNECTION SYSTEM

[75] Inventors: Richard Louis Kidd, Stow; Paul Di Liello; Thomas Alan Lubert, both of Cortland; Jeffrey Michael Hickox, Middlefield, all of Ohio

[73] Assignee: General Motors Corporation, Detroit, Mich.

[21] Appl. No.: 527,396

[22] Filed: Sep. 13, 1995

[51] Int. Cl.[6] ..... H01R 13/64

[52] U.S. Cl. ..... 439/248; 439/923

[58] Field of Search ..... 439/248, 247, 439/953, 364, 350, 534, 923; 403/350, 348

[56] References Cited

U.S. PATENT DOCUMENTS

| | | | |
|---|---|---|---|
| 3,174,576 | 3/1965 | Woofter et al. | 180/90 |
| 3,706,067 | 12/1972 | Hanson | 339/45 M |
| 4,109,987 | 8/1978 | Bourdon | 439/953 |
| 4,348,071 | 9/1982 | Hsieh | 339/75 MP |
| 4,352,538 | 10/1982 | Fowler | 339/126 R |
| 4,474,420 | 10/1984 | Nestor | 339/116 MF |
| 4,824,387 | 4/1989 | DeJong et al. | 439/248 |
| 4,848,829 | 7/1989 | Kidd | 296/152 |
| 4,869,670 | 9/1989 | Ueda et al. | 439/34 |
| 4,929,192 | 5/1990 | Beghelli | 439/534 |
| 4,942,499 | 7/1990 | Shibata et al. | 361/428 |
| 4,943,109 | 7/1990 | Skrbina et al. | 296/146 |
| 4,943,241 | 7/1990 | Watanabe et al. | 439/34 |
| 5,217,386 | 6/1993 | Ohsumi et al. | 439/248 |

FOREIGN PATENT DOCUMENTS

| | | | |
|---|---|---|---|
| 60-22776 | 2/1985 | Japan | 439/534 |

OTHER PUBLICATIONS

Publication 27208, "Surface Mounted Pivoting Card Edge Connector", Dec. 1986.

*Primary Examiner*—Gary F. Paumen

*Attorney, Agent, or Firm*—Ernest E. Helms; Cary W. Brooks

[57] ABSTRACT

A vehicle signal connection arrangement is provided including a male member having a body with first and seconds ends, the body mounting a plurality of leads extending therethrough, the body having a multi-dimensional axial inner hole with a first end and a second end with a shoulder separating the first and second ends of the hole, the shoulder having a generally oblong passage extending therethrough; a female member having a body with first and second ends for mounting a plurality of leads extending therethrough to make contact with the leads of the male member, the female body having a multi-dimensional generally axial inner hole with a first end and a second end and a shoulder separating the first and second ends of the hole, the shoulder having a generally oblong passage extending therethrough; a protrusion connected with one of the members for a snap interference fit into a depression of the other member; and a mounting member pivotally mounting the female member.

3 Claims, 5 Drawing Sheets

MODULAR CONNECTION SYSTEM

FIELD OF THE INVENTION

The field of the present invention is that of modular connector arrangements for electrical systems suitable for automotive vehicles. More particularly, the present invention is particularly useful in establishing electrical connections between components and/or controls mounted on an interior trim panel of a vehicle door with the remainder of a vehicle electrical system.

BACKGROUND OF THE INVENTION

Most automotive vehicle doors are comprised of three separate panels. An outer typically metallic, plastic or fiberglass panel is joined to an intermediate panel which forms an envelope providing general structural integrity of the vehicle door.

Mounted on the intermediate panel is a vehicle trim panel which is typically formed from a rigid plastic and is covered with a vinyl or cloth cover material to form a surface which is exposed to the vehicle occupant. The trim panel typically mounts various electrical connections and controls including, but not limited to, musical speakers, interior lighting, switches controlling the operation of the window, door locks and in some instances adjustment of a vehicle seat.

Typically, the various switches and controls and other electrical components on the trim panel have attached lead wires which are then joined via a separate individual electrical connector to a wire harness. The wire harness extends through the interior of the door and is then extended out of the door into the interior of the vehicle and thereby is connected to the remainder of the vehicle electrical system. As is apparent to those familiar with the art, as the number of component/control electrical wires which must be connected to the wire harness increases, the cost of the vehicle assembly will increase as well as providing greater opportunities for faulty electrical connections. Additionally, rattles caused by improper wire routing within the door may increase.

It would be desirable that all electrical connections between the structural door and the interior trim panel be made at one location and, additionally, that the final electrical connection between the trim panel component/controls and the wire harness be established with the interior trim panel already fixedly attached to the structural door.

To meet the above-noted needs and desires, the present invention is brought forth. The present invention provides a modular electrical connective arrangement which allow all electrical connections between a door trim panel and the wire harness in the structural door to be made at a single location.

DESCRIPTION OF THE PREFERRED EMBODIMENT

Figure 1:
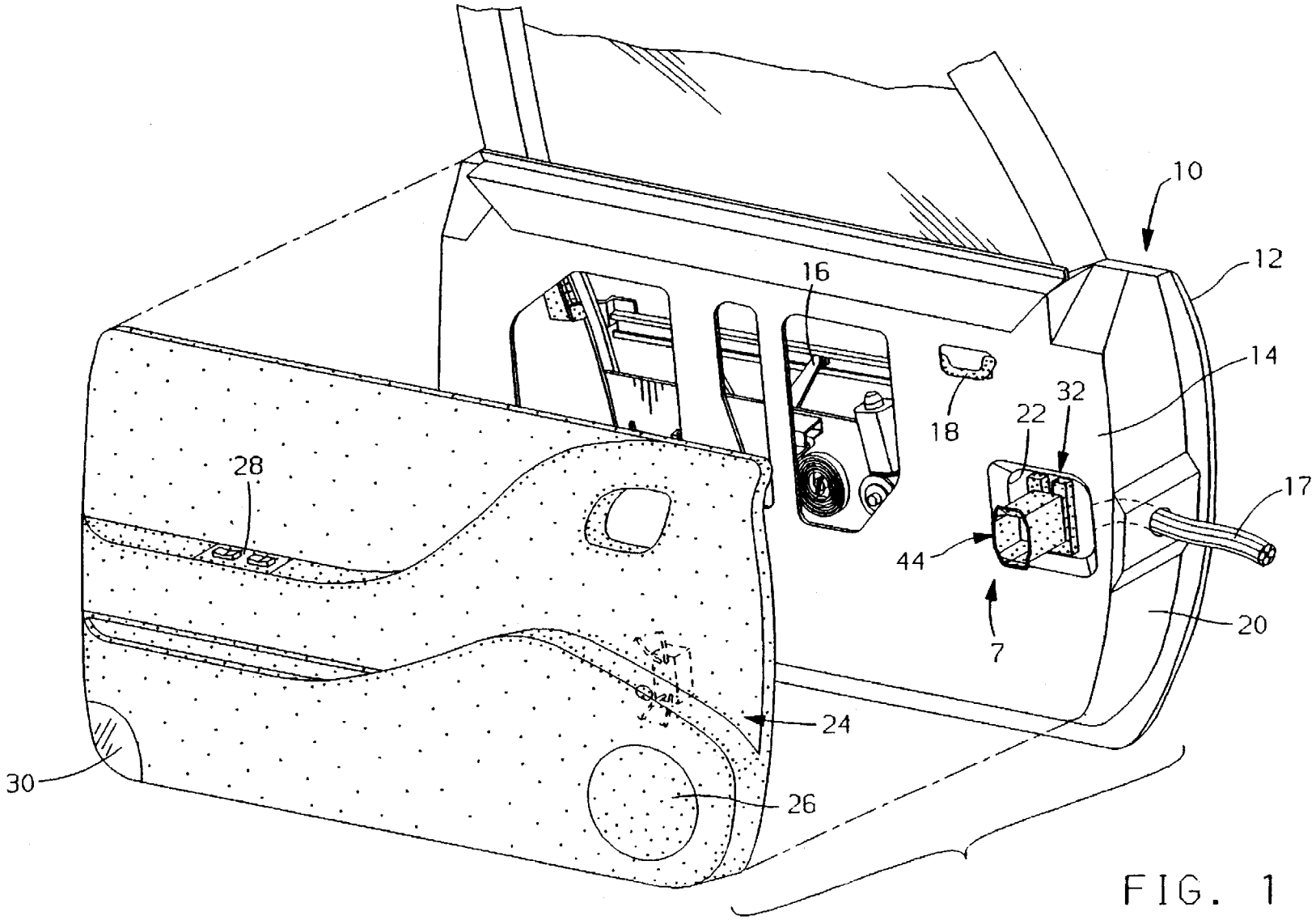
FIG. 1 is a perspective view of an automotive interior door utilizing the connection arrangement according to a preferred embodiment of the present invention.

Referring to FIG. 1, a vehicle door 10 is shown having an exterior metallic panel 12 joined to an inner panel 14 which is spaced therefrom. Together, the panels 12 and 14 form the major structural components of the vehicle door 10 and are typically metallic but in virtually all cases are generally rigid. Positioned within the vehicle door 10 is a window regulator mechanism 16, a door latch 18 and other various mechanical and nonmechanical components. A wiring harness 17 will enter the door typically around its forward end 20 and will extend to an area adjacent aperture 22 formed on the intermediate door panel 14.

Facing an occupant of the interior of a vehicle, there is an interior trim panel 24. The interior trim panel is typically formed from a generally rigid plastic which is covered with a cloth or vinyl covering having a padding material interposed therebetween. The trim panel 24 will typically have mounted thereupon a speaker 26 and a group of electrical controls 28. Additionally, many vehicle doors will have lights (not shown) to illuminate the control switches 28 or lights 30 to provide both interior lighting and lighting upon the vehicle door to alert oncoming cars that a vehicle door has been opened.

Referring additionally to FIGS. 2 through 6, the connective arrangement 7 according to the present invention provides a modular electrical connection between the electrical controls and components on the trim panel and the wiring harness. Mounted on the inner panel 14 is a female mount 32.

The mount 32 has along its end compliant or spring tabs 34 which lock the mount 32 in position. The mount will typically be fabricated from a glass fiber-filled plastic. The mount also has a ledge 36 to ensure snug abutment within the aperture 22. The mount also has two ears 38 (only one shown) which each have a slot 40. The ears 38 also have flange sides 42.

A female connection member 44 has a main body 46 with radially extending pivot arms 48 having tapered edges 50. The term "female" as used herein refers to the main body 46 and does not imply that any electrical or signal leads carried by the main body 46 are male or female.

The female member 44 is typically made from a glass fiber-filled plastic material and, by virtue of its pivot arms 48 being captured within the slots 40 of the mount 32, is pivotally mounted with respect to the mount 32 and also to the panel 14. Additionally, slots 40 allow the male member 44 to translate toward or away from the mount 32 and the trim panel 24. The pivot arm tapered surface 50 is provided to allow the female member 44 to be assembled to the mount 32 by a simple push of the pivot ear 48 against an edge 52 of the mount ear 38. Pivotal movement of the female member 44 with respect to the mount 32 will be limited by contact of a ridge 54 within side arms 42 of the mount ear 38. Additionally, the mount ears 38 are made to slightly squeeze upon the female member 44 to hold it loosely in position during the assembly of the trim panel 24 to the inner panel 14.

Referring additionally to FIGS. 3 through 7, the female member 44 has a first end 56 with an inclined, flared opening. Along the sides of the female member 44 are two longitudinal slots 58 provided for added flexibility along with an indention or opening 60 whose purpose will be described later.

Figure 2:
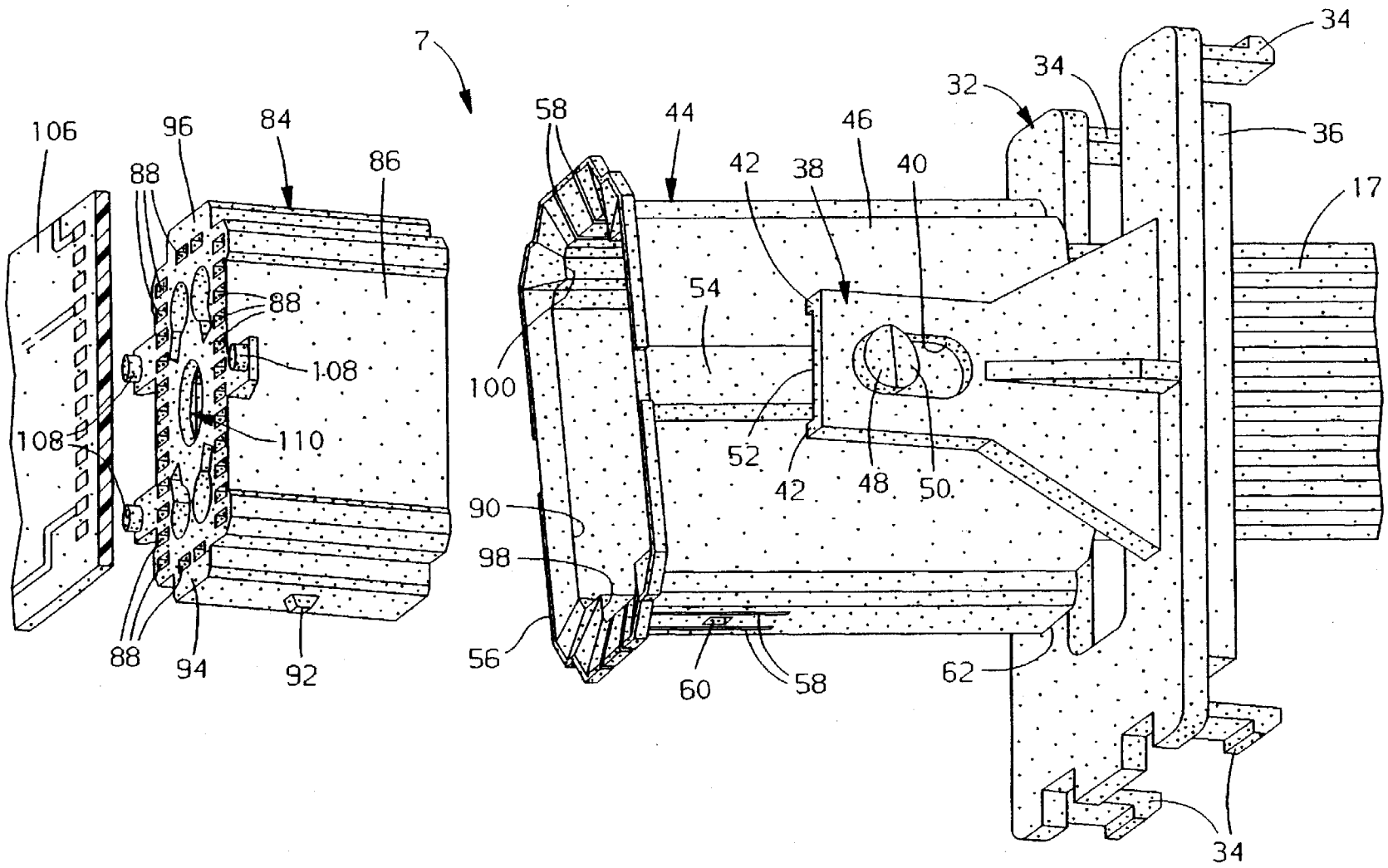
FIG. 2 is an enlarged perspective view of the connective arrangement shown in FIG. 1 with the male and female members of the connective arrangement exploded away from one another.
Figure 3:
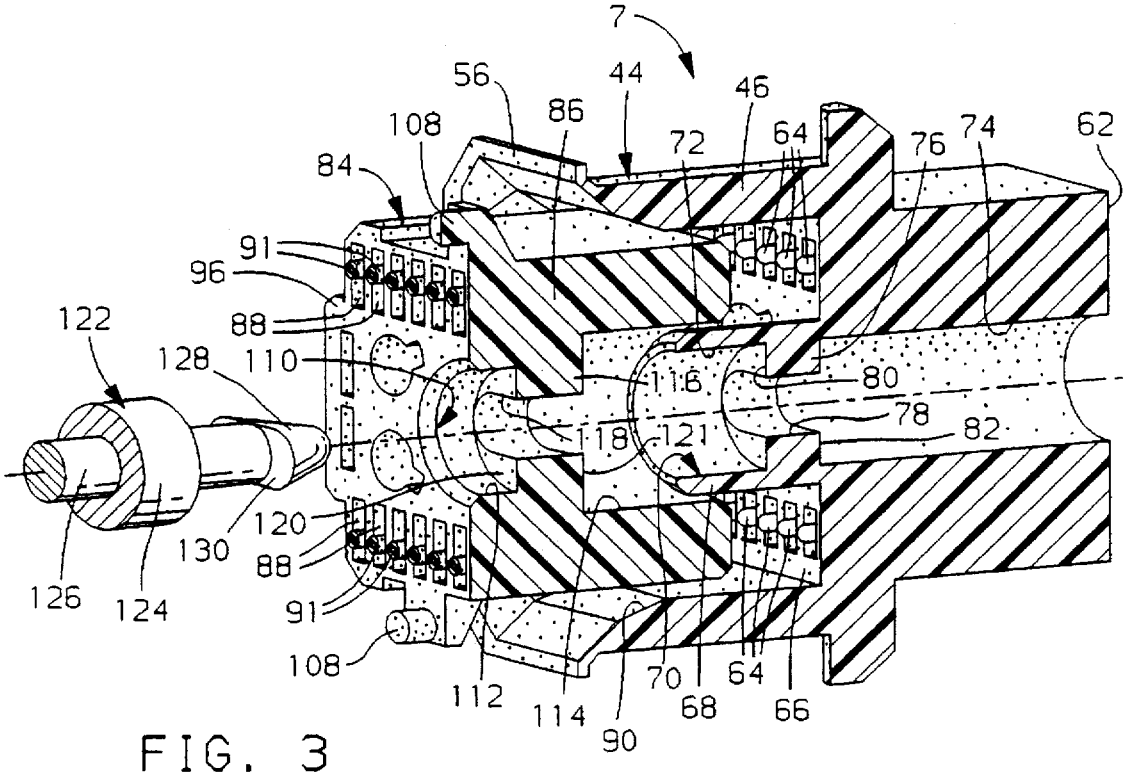
FIGS. 3 through 7 are enlarged sectional views demonstrating assembly and disassembly operation of the connective arrangement utilized according to the present invention.
Figure 4:
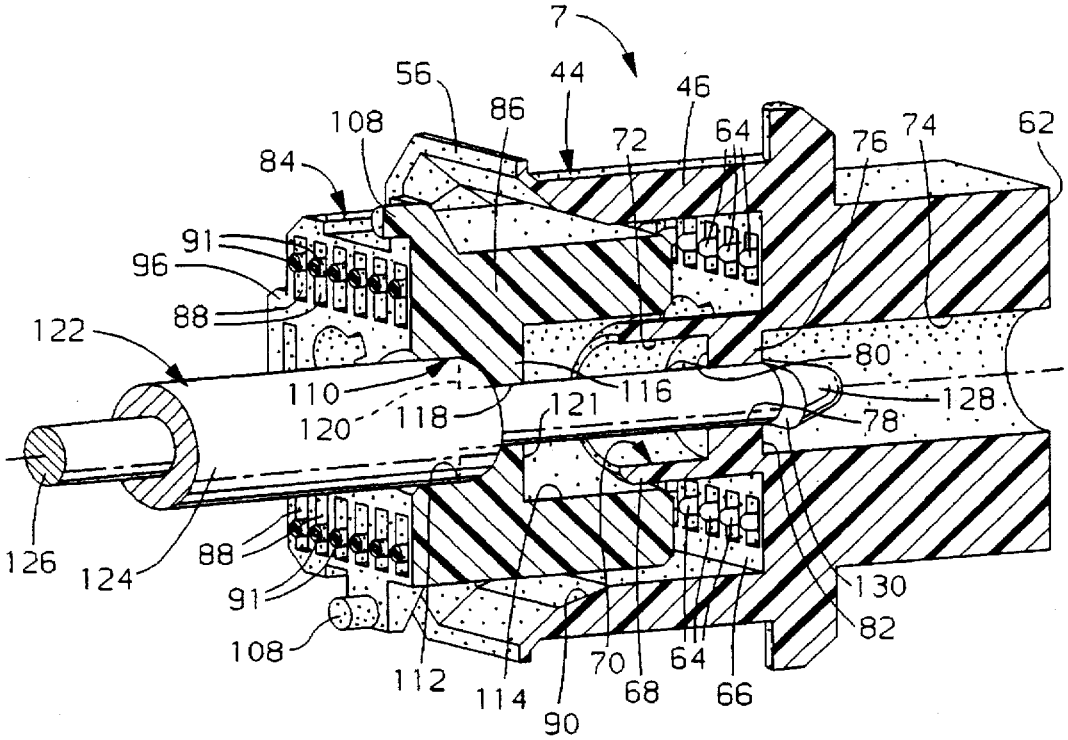
Figure 5:
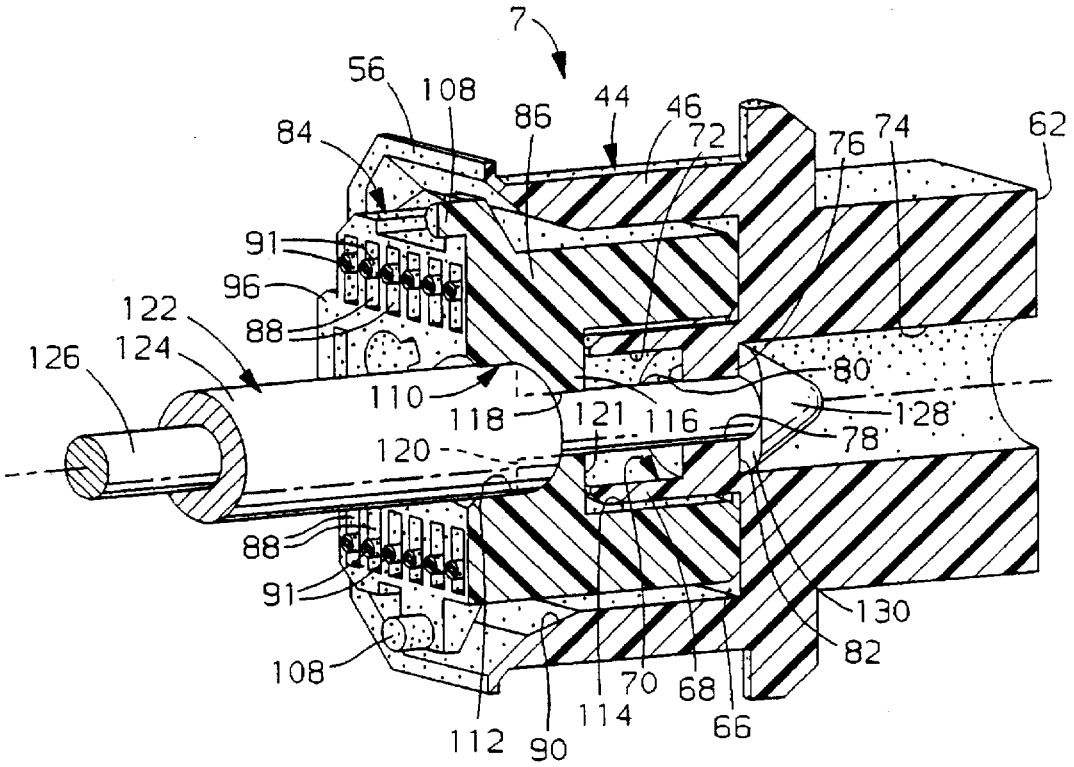

At an opposite second end 62 of the female member, the female member 44 is connected to a wiring harness 17 (see FIGS. 1 and 2). A plurality of leads 64, both electrical (signal or power) and/or optical, extend from surface 66 to surface 62 of the female member 44 to connect the leads 64 with the wiring harness 17. The female member 44 also has extending upwardly through surface 66 an alignment nipple 68. The alignment nipple 68 has a multi-dimensional, generally axial hole 70, including a first part 72 separated from a second part 74 by a shoulder 76. The shoulder 76 has an oblong hole 78 which connects the first and second portions 72, 74. The shoulder 76 has a top edge 80 and a bottom edge 82.

Fitted within an opening 90 of the female member 44 is a male member 84. The male member 84 has a body 86 fabricated from a glass-filled plastic material. The male member 84 has a series of axial holes 88 for the passage of electrical leads 91 (best shown in FIGS. 3–7) which mate with corresponding electrical leads 64 of the female member 44. The male member body 86 fits within opening 90 of the female member 44. To allow for a snap-fit retention within the female member 44, the male member has two protrusions 92 (only one shown) which fit within the recesses 60 of the female member 44. To orientate the male member 84 with respect to the female member, the male member 84 has heads 94 and 96 of differing dimensions to ensure proper orientation within the opening 90 of the female member 44 which also has recesses 98 and 100 of differing dimensions. Fitted on top of the male member 84 is a circuit board 106 which has corresponding mating holes for placement of studs 108 of the male member 84. Three studs 108 are used to ensure proper orientation of the male member 84 and the circuit board 106.

The male member 84 has a central multi-dimensional hole 110 which has a first portion 112 separated from the second portion 114 by a shoulder 116. Shoulder 116 has an oblong passage 118, a top edge 120 and a bottom edge 121.

To make the connective arrangements 7, a connector tool 122 is utilized. Connector tool 122 has an outer cylinder 124 with an inner cylinder 126 which is translatable with respect to cylinder 124. Cylinder 126 has at its end an oblong head 128. The male member body 86 is inserted into the female opening 90. The male member body 86 is then brought in close proximity to the alignment tube 68 of the female member 44. Either by individual rotation of inner member 126 or by rotation of the tool 122 in total, the tool head 128 is positioned for passage through the oblong holes 118 and 78 of the female member 44 and the male member 84. The shaft 126 is then rotated such that an edge 130 of the tool head is brought into contact with the lowered edge 82 of the female shoulder and the rod 126 is then retracted, bringing the tool head 128 toward the outer rod 122 (while the outer rod is seated against the top surface 120 of the male member). This action causes the male member 84 to continue its insertion into the female member 44 and at such time that protrusion 92 pops into depression 60 of the female member 44, thereby locking the members 44 and 84 together.

Figure 6:
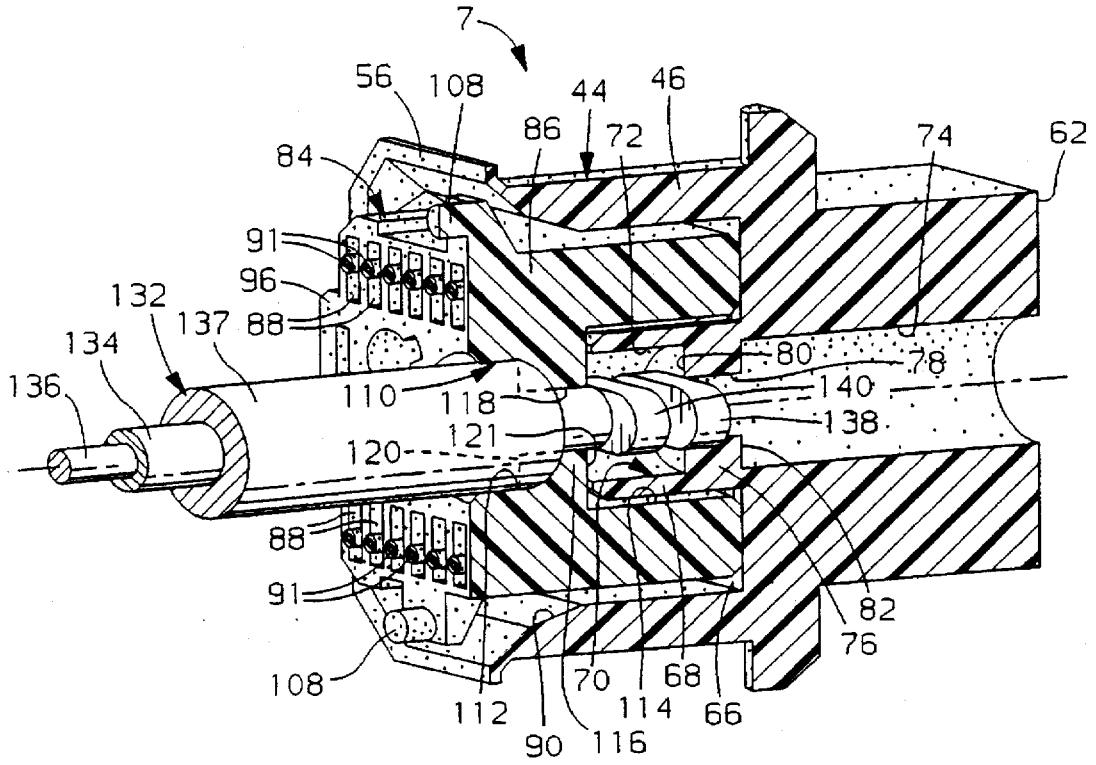
Figure 7:
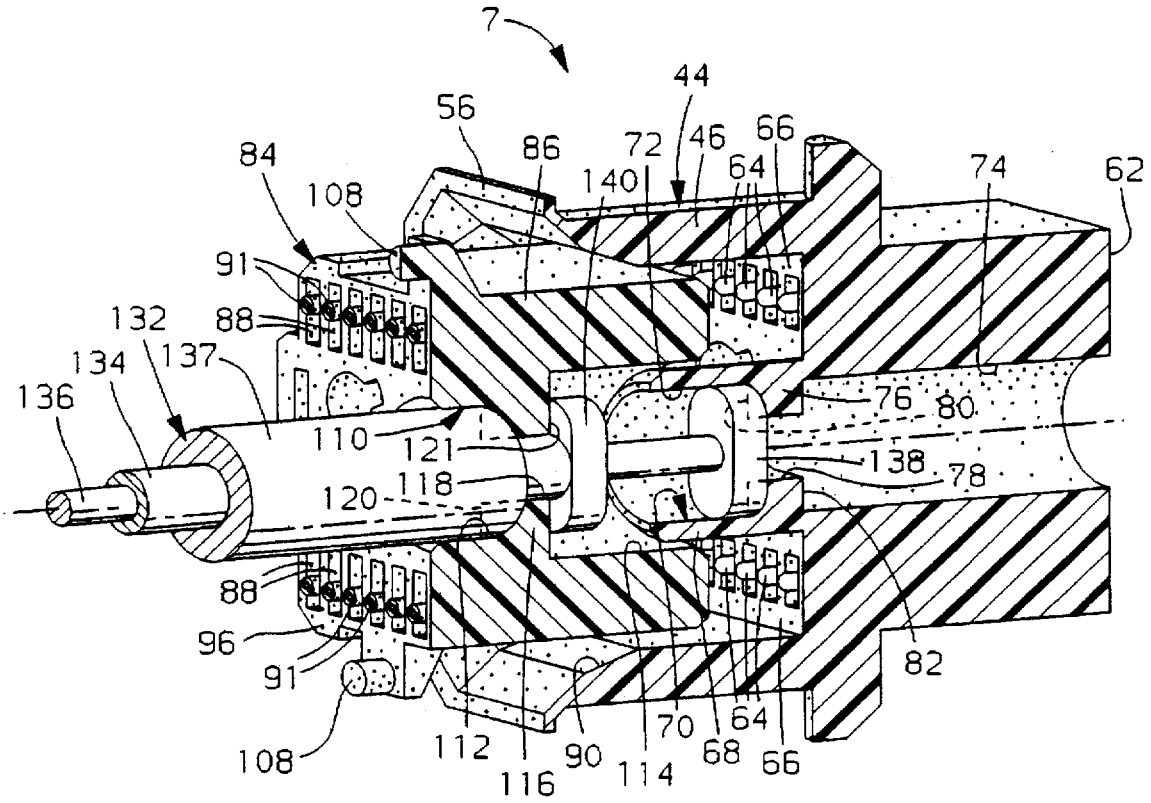

Referring to FIGS. 6 and 7, a disconnect tool 132 has two concentric inner shafts 134 and 136. The shafts 134 and 136 may translate independently of each other and of outer shaft 137. Shaft 136 has a head 138 at its end and shaft 134 has a head 140 at its end. The shafts 136 and 134, as shown in FIG. 6, are orientated such that heads 138 and 140 both pass through oblong hole 118 of the male member. The heads are then rotated such that the head 140 contacts the lower edge 121 of the male member 84 shoulder 116 and head 138 contacts the upper surface 80 of the female member 44 shoulder 76. Shafts 136 and 134 are thereafter programmed to split apart from one another, causing the head 138 to push outwardly on the female member 44 and for the head 140 to pull rearwardly on the male member 84, thereby separating the male member 84 from the female member 44.

While this invention has been described in terms of a preferred embodiment thereof, it will be appreciated that other forms could readily be adapted by one skilled in the art. Accordingly, the scope of this invention is to be considered limited only by the following claims.

What is claimed is:

1. A vehicle signal connection arrangement comprising:

a male member having a body with first and seconds ends, the body mounting a plurality of leads extending therethrough, the body having a multi-dimensional axial inner hole with a first end and a second end with a shoulder separating the first and second ends of the hole, the shoulder having a generally oblong passage extending therethrough;

a female member having a body with first and second ends for mounting a plurality of leads extending therethrough to make contact with the leads of the male member, the female body having a multi-dimensional generally axial inner hole with a first end and a second end and a shoulder separating the first and second ends of the hole, the shoulder having a generally oblong passage extending therethrough;

locking components on said male and female members to releasably lock the male and female members together;

a mounting member pivotally mounting the female member and wherein said male member and female member are both constructed and arranged to accommodate a connector tool having an outer cylinder and an inner shaft being translatable with respect to the outer cylinder, the connector tool shaft having an oblong head at one end to be inserted through the oblong passage of both the male and female member and upon rotation of the shaft the connector tool head engages the shoulder of the female member and the outer cylinder engages the shoulder of the male member and upon retraction of the shaft, the male and female members are brought together so that said locking components on said male and female members engage each other.

2. A vehicle signal connection arrangement as set forth in claim 1 wherein said male and female members are constructed and arranged to accommodate a disconnection tool having first, second and third concentric shafts, the first, second and third shafts being translatable independently of each other, the first shaft having a head at an end and the second shaft also having a head at an end, wherein said male and female members are constructed and arranged to receive the disconnection tool heads through the oblong hole formed in the male and female members, and wherein said male and female members are constructed and arranged so that the disconnection tool heads may be rotated so that the head of the first shaft engages the shoulder of the female member, and the head of the second shaft engages the shoulder of the male member, and the third shaft engages the shoulder of the male member, and so that the head on the first shaft may be pushed against the female member and the head on the second shaft pulled rearwardly on the male member thereby separating the male and female members.

3. A vehicle signal connection arrangement comprising:

a male member having a body with first and seconds ends, the body mounting a plurality of leads extending therethrough, the body having a multi-dimensional axial inner hole with a first end and a second end with a shoulder separating the first and second ends of the hole, the shoulder having a generally oblong passage extending therethrough;

a female member having a body with first and second ends for mounting a plurality of leads extending therethrough to make contact with the leads of the male member, the female body having a multi-dimensional generally axial inner hole with a first end and a second end and a shoulder separating the first and second ends of the hole, the shoulder having a generally oblong passage extending therethrough;

locking components on said male and female members to releasably lock the male and female members together;

a mounting member pivotally mounting the female member and wherein said male and female members are constructed and arranged to accommodate a disconnection tool having first, second and third concentric shafts, the first, second and third shafts being translatable independently of each other, the first shaft having a head at an end and the second shaft also having a head at an end, wherein said male and female members are constructed and arranged to receive the disconnection tool heads through the oblong hole formed in the male and female members, and wherein said male and female members are constructed and arranged so that the disconnection tool heads may be rotated so that the head of the first shaft engages the shoulder of the female member, and the head of the second shaft engages the shoulder of the male member, and the third shaft engages the shoulder of the male member, and so that the head on the first shaft may be pushed against the female member and the head on the second shaft pulled rearwardly on the male member thereby separating the male and female members.

* * * * *